US007297177B2

(12) United States Patent
Sandberg et al.

(10) Patent No.: US 7,297,177 B2
(45) Date of Patent: Nov. 20, 2007

(54) COLD WORK STEEL

(75) Inventors: Odd Sandberg, Uddeholm (SE); Lennart Jönson, Karlstad (SE); Magnus Tidesten, Hagfors (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 0 days.

(21) Appl. No.: 10/481,269

(22) PCT Filed: May 17, 2002

(86) PCT No.: PCT/SE02/00939

§ 371 (c)(1),
(2), (4) Date: Dec. 19, 2003

(87) PCT Pub. No.: WO03/000944

PCT Pub. Date: Jan. 3, 2003

(65) Prior Publication Data

US 2004/0134568 A1 Jul. 15, 2004

(30) Foreign Application Priority Data

Jun. 21, 2001 (SE) ..... 0102233

(51) Int. Cl.
*C22C 38/22* (2006.01)
*C22C 38/24* (2006.01)

(52) U.S. Cl. ..... 75/246; 75/239; 148/334; 420/111

(58) Field of Classification Search ..... 75/246, 75/239; 148/321, 334; 420/9, 10, 111
See application file for complete search history.

(56) References Cited

U.S. PATENT DOCUMENTS 4,863,515 A * 9/1989 Roberts et al. ..... 75/238
5,651,842 A * 7/1997 Nakamura et al. ..... 148/321

FOREIGN PATENT DOCUMENTS

| | | | |
|---|---|---|---|
| EP | 0 630 984 | A1 | 12/1994 |
| JP | 07-011398 | A | 1/1995 |
| SE | 457 356 | B | 12/1998 |
| WO | WO 98/40180 | | 9/1998 |
| WO | WO 98/40180 | A1 | 9/1998 |
| WO | WO 01/25499 | A1 | 4/2001 |

* cited by examiner

*Primary Examiner*—Deborah Yee
(74) *Attorney, Agent, or Firm*—Barnes & Thornburg LLP

(57) ABSTRACT

A cold work steel has the following chemical composition in weight-%: 1.25-1.75% (C+N), however at least 0.5% C 0.1-1.5% Si 0.1-1.5% Mn 4.0-5.5% Cr 2.5-4.5% (Mo+W/2), however max. 0.5% W 3.0-4.5% (V+Nb/2), however max. 0.5% Nb max 0.3% S balance iron and unavoidable impurities, and a microstructure which in the hardened and tempered condition of the steel contains 6-13 vol-% of vanadium-rich MX-carbides, -nitrides and/or carbonitrides which are evenly distributed in the matrix of the steel, where X is carbon and/or nitrogen, at least 90 vol-% of said carbides, nitrides and/or carbonitrides having an equivalent diameter, Deq, which is smaller than 3.0 μm; and totally max. 1 vol-% of other, possibly existing carbides, nitrides or carbonitrides.

18 Claims, 6 Drawing Sheets

COLD WORK STEEL

This application is the U.S. National Phase of International Application PCT/SE02/00930, filed 17 May 2002, which designated the U.S.

TECHNICAL FIELD

The invention concerns a cold work steel, i.e. a steel intended to be used for working a material in the cold condition of the material. Typical examples of the use of the steel are tools for shearing (cutting) and blanking (punching), threading, e.g., for thread rolling dies and thread taps; cold extrusion tooling, powder pressing, deep drawing and for machine knives. The invention also concerns the use of the steel for the manufacturing of cold work tools, the manufacturing of the steel and tools made of the steel.

BACKGROUND OF THE INVENTION

Several demands are raised on cold work steel of high quality, including a proper hardness for the application, a high wear resistance, and a high toughness. For optimal tool performance both high wear resistance and good toughness are essential. VANADIS® 4 is a powder metallurgical cold work steel manufactured and marketed by the applicant, offering an extremely good combination of wear resistance and toughness for high performance tools. The steel has the following nominal composition in weight-%: 1.5 C, 1.0 Si, 0.4 Mn, 8.0 Cr, 1.5 Mo, 4.0 V, balance iron and unavoidable impurities. The steel is especially suitable for applications where adhesive wear and/or chipping are the dominating problems, i.e. with soft/adherent working materials such as austenitic stainless steel, mild carbon steel, aluminium, copper, etc. and also with thicker work materials. Typical examples of cold work tools, where the steel may be used are those which have been mentioned in the above preamble. Generally speaking, VANADIS® 4, which is subject of the Swedish patent No. 457 356, is characterised by good wear resistance, high pressure strength, good hardenability, very good toughness, very good dimension stability when subjected to heat treatment, and good tempering resistance; all said features being important features of a high performance cold work steel.

The applicant also has designed a steel WO 01/25499, having the following chemical composition in weight-%: 1.0-1.9 C, 0.5-2.0 Si, 0.1-1.5 Mn, 4.0-5.5 Cr, 2.5-4.0 (Mo+W/2), however max. 1.0 W, 2.0-4.5 (V+Nb/2), however max. 1.0 Nb, balance iron and impurities and having a microstructure, which in the hardened and tempered condition of the steel contains 5-12 vol-% MC-carbides, of which at least 50 vol-% have a size which is larger than 3 μm but smaller than 25 μm. This microstructure is obtained by spray-forming an ingot. The composition and microstructure affords the steel features which are suitable for rolls for cold rolling, including suitable toughness and wear resistance. Further, a high speed steel manufactured in a conventional way by ingot casting is disclosed in EP 0 630 984 A1. According to a described example, the steel contained 0.69 C, 0.80 Si, 0.30 Mn, 5.07 Cr, 4.03 Mo, 0.98 V, 0.041 N, balance iron. That steel, the microstructure of which also is shown in the patent document, after hardening and tempering contained totally 0.3 vol-% carbides of type $M_2C$ and $M_6C$, and 0.8 vol-% MC-carbides. The latter ones had an essentially spherical shape and the large sizes which are typical for high vanadium steels manufactured in a conventional way comprising ingot casting. The steel is said to be suitable for "plastic working".

The above mentioned steel VANADIS® 4 has been manufactured since about 15 years and has due to its excellent features reached a leading position on the market place for high performance cold work steels. It is now the objective of the applicant to offer a high performance cold work steel having still better toughness than VANADIS® 4 while other features are maintained or improved in comparison with VANADIS® 4. The field of use of the steel in principle is the same as for VANADIS® 4.

DISCLOSURE OF THE INVENTION

The above objectives can be achieved therein that the steel has the following chemical composition in weight-%: 1.25-1.75 (C+N), however at least 0.5 C, 0.1-1.5% Si, 0.1-1.5% Mn, 4.0-5.5 Cr, 2.5-4.5% (Mo+W/2), however max. 0.5% W, 3.0-4.5% (V+Nb/2), however max. 0.5% Nb, max. 0.3% S, balance iron and unavoidable impurities, and a microstructure, which in the hardened and tempered condition of the steel, contains 6-13 vol-% of vanadium-rich MX-carbides, -nitrides and/or carbonitrides which are evenly distributed in the matrix of the steel, where X is carbon and/or nitrogen, at least 90 vol-%, of said carbides, nitrides and/or carbonitrides having an equivalent diameter, $D_{eq}$, which is smaller than 3.0 μm, and preferably smaller than 2.5 μm in a studied section of the steel; and totally max. 1 vol-% of other, possibly existing carbides, nitrides or carbonitrides. The carbides have a predominately round or rounded shape but individual, longer carbides may occur. Equivalent diameter, $D_{eq}$ is defined in this context as $Deq=2\sqrt{A/\pi}$, where A is the surface of the carbide particle in the studied section. Typically, at least 98 vol-% of the MX-carbides, nitrides and/or carbonitrides have a $D_{eq}<3.0$ μm. Normally, the carbides/nitrides/carbonitrides also are spherodised to such a high degree that no carbides have a real length in the studied section exceeding 3.0 μm.

In the hardened condition, the matrix consists essentially only of martensite, which contains 0.3-0.7, preferably 0.4-0.6% C in solid solution. The steel has a hardness of 54-66 HRC after hardening and tempering.

In the soft annealed condition, the steel has a ferritic matrix containing 8-15 vol-% vanadium-rich MX-carbides, nitrides, and/or carbonitrides, of which at least 90 vol-% have an equivalent diameter smaller than 3.0 μm and preferably also smaller than 2.5 μm, and max. 3 vol-% of other carbides, nitrides and/or carbonitrides.

If otherwise is not stated, always weight-% is referred to concerning the chemical composition, and vol-% is referred to concerning the structural composition of the steel.

As far as the individual alloy elements and their mutual relationship, the structure of the steel and its heat treatment are concerned, the following apply.

Carbon shall exist in a sufficient amount in the steel in order, in the hardened and tempered condition of the steel, to form, in combination with nitrogen, vanadium, and possibly existing niobium, and to some degree also other metals, 6-13 vol-%, preferably 7-11 vol-% MX-carbides, nitrides or carbonitrides, and also exist in solid solution in the matrix of the steel in the hardened condition of the steel in an amount of 0.3-0.7, preferably 0.4-0.6 weight-%. Suitably, the content of dissolved carbon in the matrix of the steel is about 0.53%. The total amount of carbon and nitrogen in the steel, including carbon which is dissolved in the matrix of the steel plus that carbon which is bound in carbides, nitrides or carbonitrides, i.e. % (C+N), shall be at least 1.25, preferably at least 1.35%, while the maximal content of C+N may amount to 1.75%, preferably max. 1.60%.

According to a first preferred embodiment of the invention, the steel does not contain more nitrogen than what unavoidably will exist in the steel because of take up from the environment and/or through supplied raw materials, i.e. max. about 0.12%, preferably max. about 0.10%. According to a conceived embodiment, however, the steel may contain a larger, intentionally added content of nitrogen, which may be supplied through solid phase nitriding of the steel powder which is used in the manufacturing of the steel. In this case, the main part of C+N may consist of nitrogen, which implies that said MX-particles in this case mainly consist of vanadium carbonitrides in which nitrogen is the substantial ingredient together with vanadium, or even consist of pure vanadium nitrides, while carbon exists essentially only as a dissolved ingredient in the matrix of the steel in the hardened and tempered condition of the steel.

Silicon is present as a residue from the manufacturing of the steel in an amount of at least 0.1%, normally in an amount of at least 0.2%. Silicon increases the carbon activity in the steel and therefore contributes to affording the steel an adequate hardness. If the content of silicon is too high, embrittlement problems may arise because of solution hardening, wherefore the maximal silicon content of the steel is 1.5%, preferably max. 1.2%, suitably max. 0.9%.

Manganese, chromium and molybdenum shall exist in the steel in a sufficient amount in order to afford the steel an adequate hardenability. Manganese also has the function of binding those amounts of sulphur which may exist in the steel to form manganese sulphides. Manganese therefore shall exist in an amount of 0.1-1.5%, preferably in an amount of 0.1-1.2, suitably 0.1-0.9%.

Chromium shall exist in an amount of at least 4.0%, preferably at least 4.5% in order to give the steel a desired hardenability in combination with in the first place molybdenum but also manganese. The chromium content, however, must not exceed 5.5%, preferably not exceed 5.2%, in order that undesired chromium carbides shall not be formed in the steel.

Molybdenum shall exist in an amount of at least 2.5% in order to afford the steel a desired hardenability in spite of the limited content of manganese and chromium which characterizes the steel. Preferably, the steel should contain at least 2.8%, suitably at least 3.0% molybdenum. Maximally, the steel may contain 4.5%, preferably max. 4.0% molybdenum in order that the steel shall not contain undesired $M_4C$-carbides instead of the desired amount of MC-carbides. Higher contents of molybdenum further may cause undesired loss of molybdenum because of oxidation in connection with the manufacturing of the steel. In principle, molybdenum may completely or partly be replaced by tungsten, but for this twice as much tungsten is required as compared with molybdenum, which is a drawback. Also any scrap which may be produced in connection with the manufacturing of the steel or in connection with the manufacturing of articles made of the steel, will be of less value for recycling if the steel contains significant amounts of tungsten. Therefore tungsten should not exist in an amount of more than max. 0.5%, preferably max. 0.3%, suitably max. 0.1%. Most conveniently, the steel should not contain any intentionally added tungsten, which according to the most preferred embodiment should not be tolerated more than as an impurity in the form of a residual element from the raw materials which are used in connection with the manufacturing of the steel.

Vanadium shall exist in the steel in an amount of at least 3.0% but not more than 4.5%, preferably at least 3.4% and max. 4.0%, in order, together with carbon and nitrogen, to form said MX-carbides, nitrides and/or carbonitrides in a total amount of 6-13%, preferably 7-11 vol-%, in the hardened and tempered use condition of the steel. In principle, vanadium may be replaced by niobium, but this requires twice as much niobium as compared with vanadium, which is a drawback. Further, niobium may have the effect that the carbides, nitrides and/or carbonitrides may get a more edgy shape and be larger than pure vanadium carbides, nitrides and/or carbonitrides, which may initiate ruptures or shippings and therefore reduce the toughness of the material. Niobium therefore must not exist in an amount exceeding 0.5%, preferably max. 0.3% and suitably max. 0.1%. Most conveniently the steel should not contain any intentionally added niobium. In the most preferred embodiment of the steel, niobium therefore should be tolerated only as an unavoidably impurity in the form of a residual element from the raw materials which are used in connection with the manufacturing of the steel.

According to the first embodiment, sulphur may exist as an impurity in an amount of not more than 0.03%. In order to improve the machinability of the steel, however, it is conceivable that the steel, according to an embodiment, contains intentionally added sulphur in an amount up to max. 0.3%, preferably max. 0.15%.

At the manufacturing of the steel, first a bulk of molten steel is prepared, containing intended contents of carbon, silicon, manganese, chromium, molybdenum, possibly tungsten, vanadium, possibly niobium, possibly sulphur above impurity level, nitrogen in an unavoidable degree, balance iron and impurities. From this molten material, powder is manufactured by the employment of nitrogen gas atomisation. The drops which are formed at the gas atomisation are cooled very rapidly, so that the formed vanadium carbides and/or mixed vanadium- and niobium carbides do not get sufficient time to grow but remain extremely thin—thicknesses of only a fraction of a micrometer—and get a pronouncedly irregular shape, which is due to the fact that the carbides are precipitated in remaining regions containing molten material in the networks of the dendrites in the rapidly solidifying droplets, before the droplets completely solidify to form powder grains. If the steel shall contain nitrogen above the unavoidable impurity level, the supply of nitrogen can be performed by nitriding the powder, e.g., in the mode which is described in SE 462 837.

After sieving, which is performed prior to the nitriding if the powder shall be nitrided, the powder is filled in capsules, which are evacuated, closed and subjected to hot isostatic pressing, HIP-ing, in a mode which is known per se, at high temperature and high pressure; 950-1200° C. and 90-150 MPa; typically at about 1150° C. and 100 MPa, so that the powder is consolidated to form a completely dense body.

Through the HIP-ing operation, the carbides/nitrides/carbonitrides obtain a much more regular shape than in the powder. The great majority, with reference to volume, has a size of max. about 1.5 μm and a rounded shape. Individual particles are still elongated and somewhat longer, max. about 2.5 μm. The transformation probably is attributed to a combination of on one hand disintegration of the very thin particles in the powder and on the other hand coalescence.

The steel can be used in the as HIP-ed condition. Normally, however, the steel is hot worked subsequent to the HIP-ing through forging and/or hot rolling. This is performed at a start temperature between 1050 and 1150° C., preferably at about 1100° C. This causes further coalescence and, above all, globularisation (spheroidisation) of the carbides/nitrides/carbonitrides. At least 90 vol-% of the carbides have a maximal size of 2.5 μm, preferably max. 2.0 μm after forging and/or hot rolling.

In order that the steel shall be able to be machined by means of cutting tools, it first must be soft annealed. This is carried out at a temperature below 950° C., preferably at about 900° C., in order to inhibit growth of the carbides/nitrides/carbonitrides. The soft annealed material therefore is characterized by a very finely dispersed distribution of MX-particles in a ferritic matrix, which contains 8-15 vol-% MX-carbides, nitrides and/or carbonitrides of which at least 90 vol-% has an equivalent diameter which is smaller than 3.0 μm and which preferably also is smaller than 2.5 μm, and max. 3 vol-% of other carbides, nitrides and/or carbonitrides.

The tool is hardened and tempered when it has got its final shape through cutting type of machining. The austenitising is carried out at a temperature between 940 and 1150° C., preferably at a temperature below 1100° C. in order to avoid undesirably great dissolution of MX-carbides, nitrides and carbonitrides. A suitable austenitising temperature is 1000-1040° C. The tempering can be performed at a temperature between 200 and 560° C., either as a low temperature tempering at a temperature between 200 and 250° C., or as a high temperature tempering at a temperature between 500 and 560° C. The MX-carbides/nitrides/carbonitrides are dissolved to a certain degree at the austenitising such that they can be secondary precipitated in connection with the tempering. The final result is the microstructure which is typical for the invention, namely a structure consisting of tempered martensite and, in the tempered martensite, 6-13 vol-%, preferably 7-11 vol-%, MX-carbides, nitrides and/or carbonitrides where M essentially consists of vanadium and X consists of carbon and nitrogen, preferably substantially carbon, of which carbides, nitrides and/or carbonitrides at least 90 vol-% have an equivalent diameter of max. 2.5 an, preferably max. 2.0 μm, and totally max. 1 vol-% of possibly existing other types of carbides, nitrides or carbonitrides in the tempered martensite. Prior to tempering, the martensite contains 0.3-0.7, preferably 0.4-0.6% carbon in solid solution.

Further features and aspects of the invention is apparent from the appending patent claims and from the following description of performed experiments.

BRIEF DESCRIPTION OF DRAWINGS

In the following description of performed tests, reference will be made to the accompanying drawings, in which.

DESCRIPTION OF PERFORMED TESTS

The chemical composition of the tested steels are stated in table 1. In the table, the content of tungsten is stated for some of the steels, which content exists in the steel as a residue from the raw materials which are used for the manufacturing of the steel and is therefore an unavoidable impurity. The sulphur, which is stated for some of the steels, also is an impurity. The steel contains other impurities as well, which do not exceed normal impurity levels and which are not stated in the table. The balance is iron. In table 1, steels B and C have a chemical composition according to the invention. Steels A, D, E and F are reference materials; more particularly of type VANADIS® 4.

TABLE 1

Chemical composition in weight-% of tested steels

| Steel | C | Si | Mn | S | Cr | Mo | W | V | N |
|---|---|---|---|---|---|---|---|---|---|
| A | 1.56 | 0.92 | 0.40 | n.a. | 8.15 | 1.48 | n.a. | 3.89 | 0.067 |
| B | 1.55 | 0.89 | 0.44 | n.a. | 4.51 | 3.54 | n.a. | 3.79 | 0.046 |
| C | 1.37 | 0.38 | 0.37 | 0.015 | 4.81 | 3.50 | 0.10 | 3.57 | 0.064 |
| D | 1.55 | 1.06 | 0.44 | 0.015 | 7.95 | 1.59 | 0.14 | 3.87 | 0.107 |
| E | 1.55 | 1.04 | 0.41 | 0.016 | 7.95 | 1.49 | 0.14 | 3.72 | 0.088 |
| F | 1.53 | 1.05 | 0.40 | 0.015 | 7.97 | 1.50 | 0.06 | 3.84 | 0.088 |

n.a. = not analyzed

Figure 1:
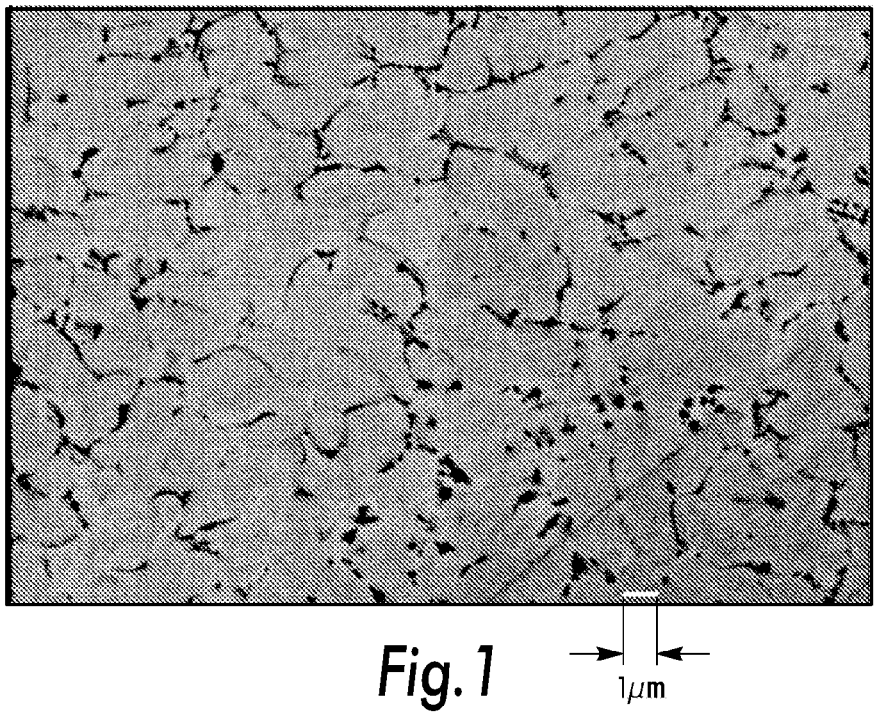
FIG. 1 shows the microstructure at a very large magnification of a metal powder of the type which is used for the manufacturing of the steel according to the invention.

Bulks of molten steel with the chemical compositions of the steels A-F according to table 1 where prepared according to conventional, melt metallurgical technique. Metal powders where manufactured of the molten material by nitrogen gas atomisation of a stream of molten metal. The formed droplets were cooled very rapidly. The microstructure of steel B was examined. The structure is shown in FIG. 1. As is apparent from this figure, the steel contains very irregularly shaped, very thin carbides, which have been precipitated in the remaining regions containing molten metal in the net work of the dendrites.

Figure 2:
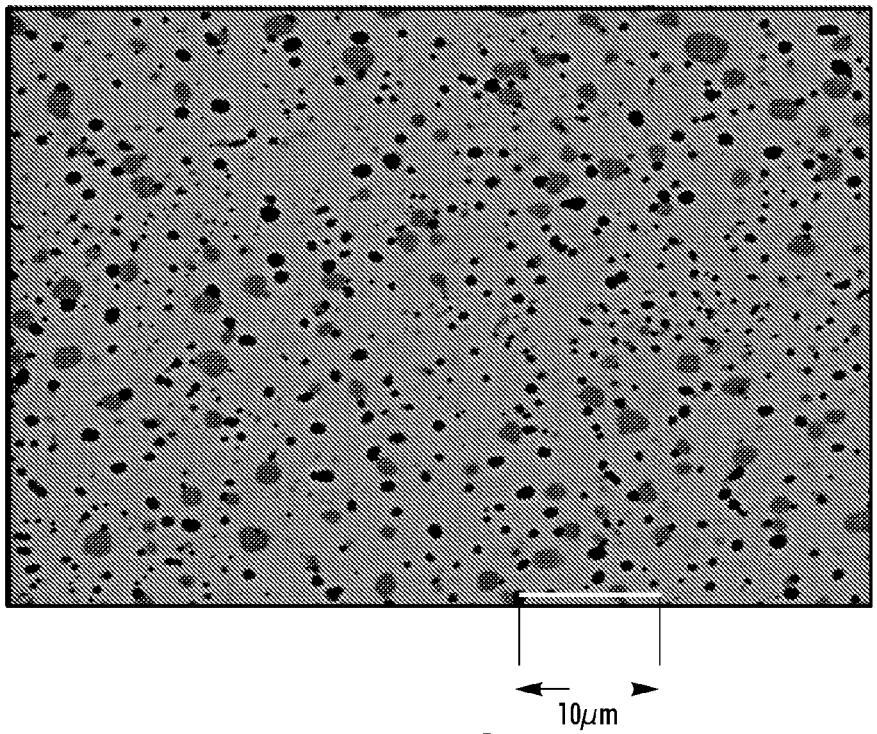
FIG. 2 shows the microstructure of the same steel material after HIP-ing, however at a smaller magnification.

HIP-ed material was also produced at a small scale of powders of steels A and B. 10 kg powder of each of the steels A and B were filled in metal sheet capsules, which were closed, evacuated and heated to about 1150° C. and were then hot isostatic pressed (HIP-ed) at about 1150° C. and a pressure of 100 MPa. At the HIP-ing operation the originally obtained carbide structure of the powder was broken down at the same time as the carbides coalesced. The result which was obtained for the HIP-ed steel B is apparent from FIG. 2. The carbides in the HIP-ed condition of the steel have got a more regular shape, which is closer the spherodised shape. They are still very small. The great majority, more than 90 vol-%, have an equivalent diameter of max. 2 μm, preferably max. about 2.0 μm.

Figure 3:
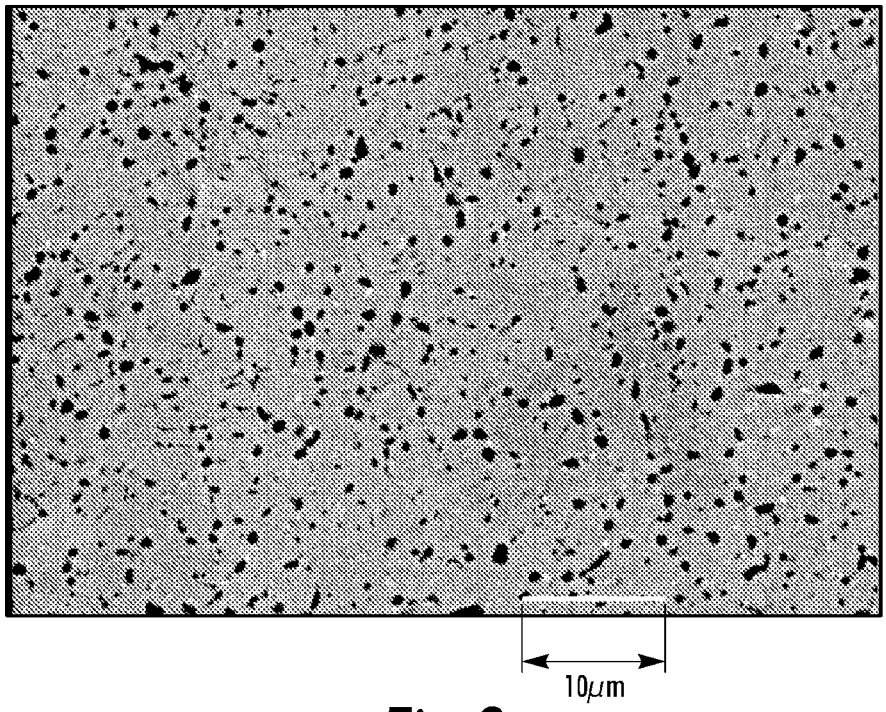
FIG. 3 shows the same steel material as in FIG. 2 after forging.
Figure 4:
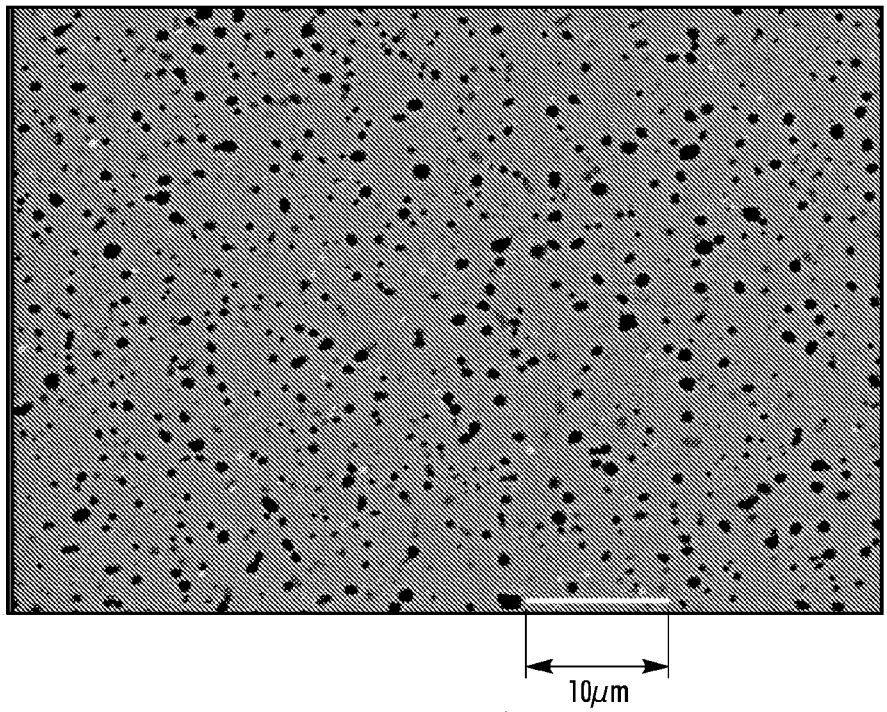
FIG. 4 shows the microstructure of a reference material after HIP-ing and forging.

Then the capsules were forged at a temperature of 1100° C. to dimension 50×50 mm. The structure of the material of the invention, steel B, and of the reference material, steel A, after forging, are apparent from FIG. 3 and FIG. 4, respectively. In the material of the invention the carbides in the form of essentially spherodised (globular) MC-carbides were very small, still max. about 2.0 μm in size, in terms of equivalent diameter. Only few carbides of other types, more specifically molybdenum-rich carbides, probably of type $M_6C$, could be detected in the steel of the invention. The total amount of these carbides was less than 1 vol-%. In the reference material, steel A, FIG. 4, on the other hand the volume fractions of MC-carbides and chromium-rich carbides of type $M_7C_3$ were approximately equally large. Further, the carbide sizes were essentially larger than in the steel of the invention.

Thereafter full scale test were performed. Powders were produced of steels having chemical compositions according to table 1, steels C—F, in the same way as has been described above. Blanks having a mass of 2 tons were produced of steel C of the invention by HIP-ing in a mode which is known per se. Thus the powder was filled in capsules which were closed, evacuated, heated to about 1150° C. and hot isostatic pressed at that temperature at a pressure of about 100 MPa. Of the reference steels D, E and F, there were produced HIP-ed blanks according to the applicant's manufacturing praxis for steel of type VANADIS® 4. The blanks were forged and rolled at about 1100° C. to the following dimensions; steel C: 200×80 mm, steel D: 152×102 mm and steel E: Ø 125 mm.

Figure 5:
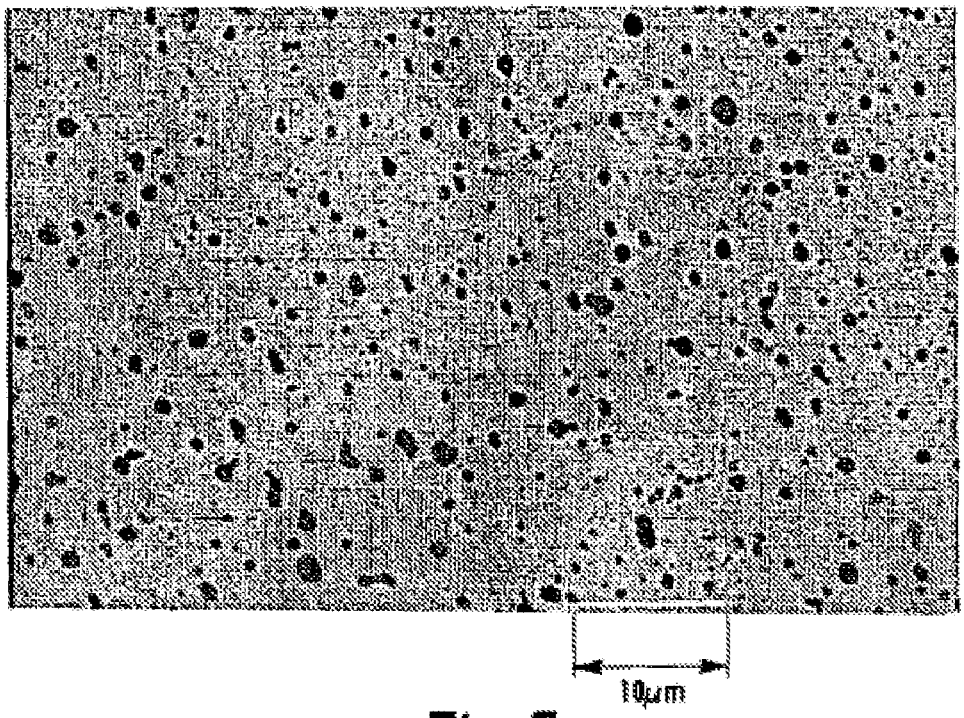
FIG. 5 shows the microstructure of the steel according to the invention after hardening and tempering.
Figure 6:
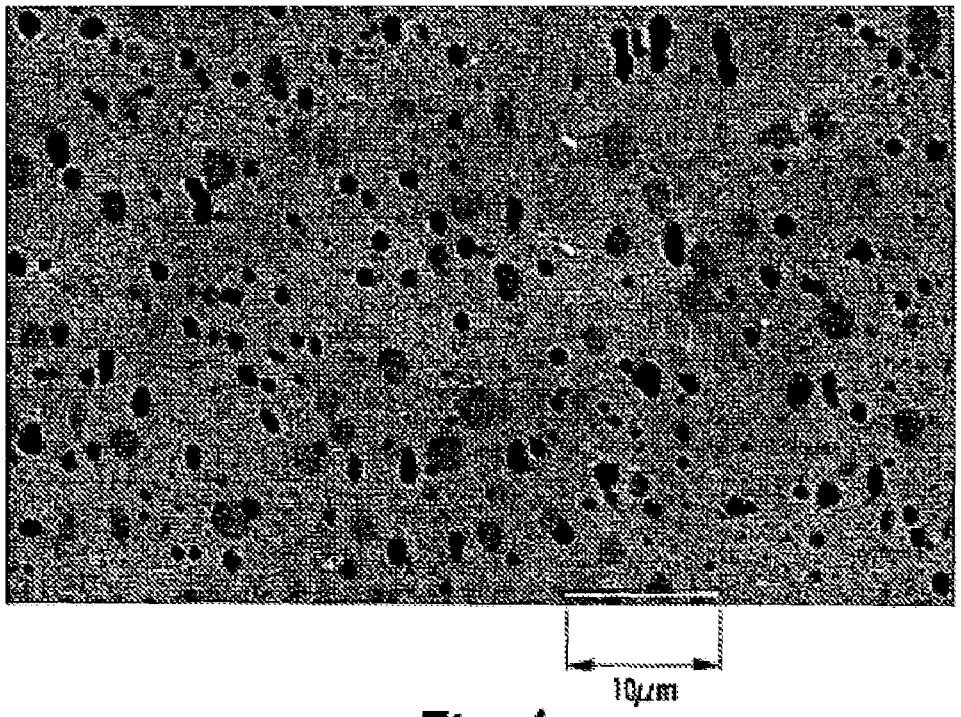
FIG. 6 shows the microstructure of the reference material after hardening and tempering.

Samples were taken from the materials after soft annealing at about 900° C. The heat treatment in connection with hardening and tempering is stated in table 2. The microstructures of steels C and F were examined in the hardened and tempered condition of the steels and are shown in FIG. 5 and FIG. 6. The steel of the invention, FIG. 5, contained 9.5 vol-% MC-carbides in the matrix, which consisted of tempered martensite. Any carbides and/or carbonitrides of other type than the MC-carbides were difficult to detect. Anyhow, the amount of such possible, further carbides, e.g., $M_7C_3$-carbides, anyhow was less than 1 vol-%. Occasional carbides having an equivalent diameter larger than 2.0 μm could be detected in the steel of the invention in the hardened and tempered condition of the steel, but no ones were larger than 2.5 μm.

The reference material, steel F, FIG. 6, contained totally about 13 vol-% carbides, thereof about 6.5 vol-% MC-carbide and about 6.5 vol-% $M_7C_3$-carbides, in the hardened and tempered condition of the steel.

The hardness obtained after the heat treatment stated in table 2 is also stated in table 2. Steel C according to the invention achieved a hardness of 59.8 HRC in the hardened and tempered condition, while the reference steels D and E got a hardness of 58.5 and 61.7 HRC, respectively.

Figure 7:
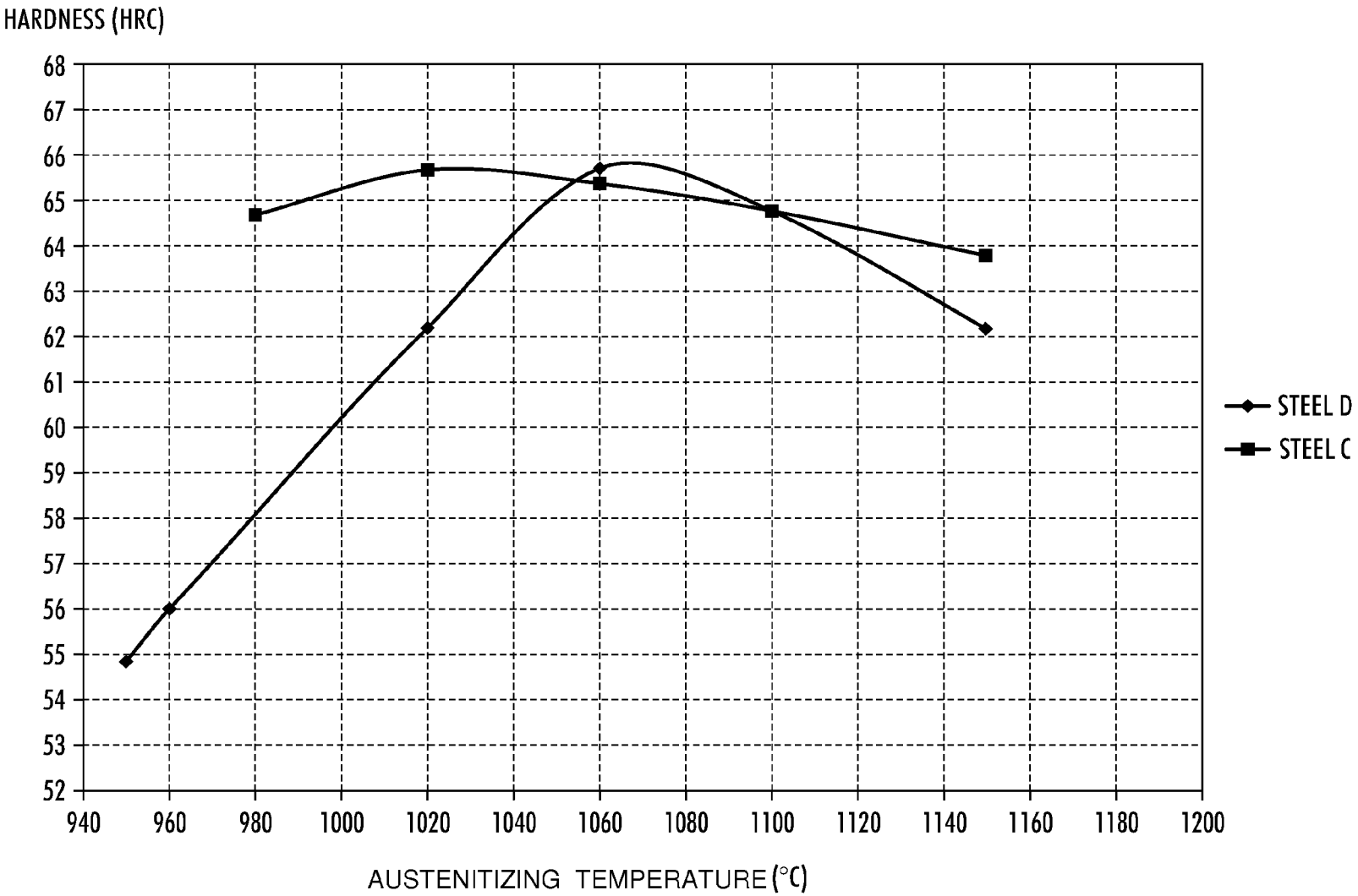
FIG. 7 is a diagram showing the hardness of a steel according to the invention and the hardness of a reference material versus the austenistising temperature.

The hardnesses of the steels C and D that could be achieved after different austenitising temperatures and tempering temperatures were also investigated. The results are apparent from the curves in FIG. 7 and FIG. 8. Steel C of the invention, FIG. 7, had a hardness which was very little dependent on the austenitising temperature. This is advantageous, because it allows a comparatively low austenitising temperature. 1020° C. turned out to be the most suitable austenitising temperature, while the reference steel had to be heated to about 1060-1070° C. in order to achieve maximal hardness.

Figure 8:
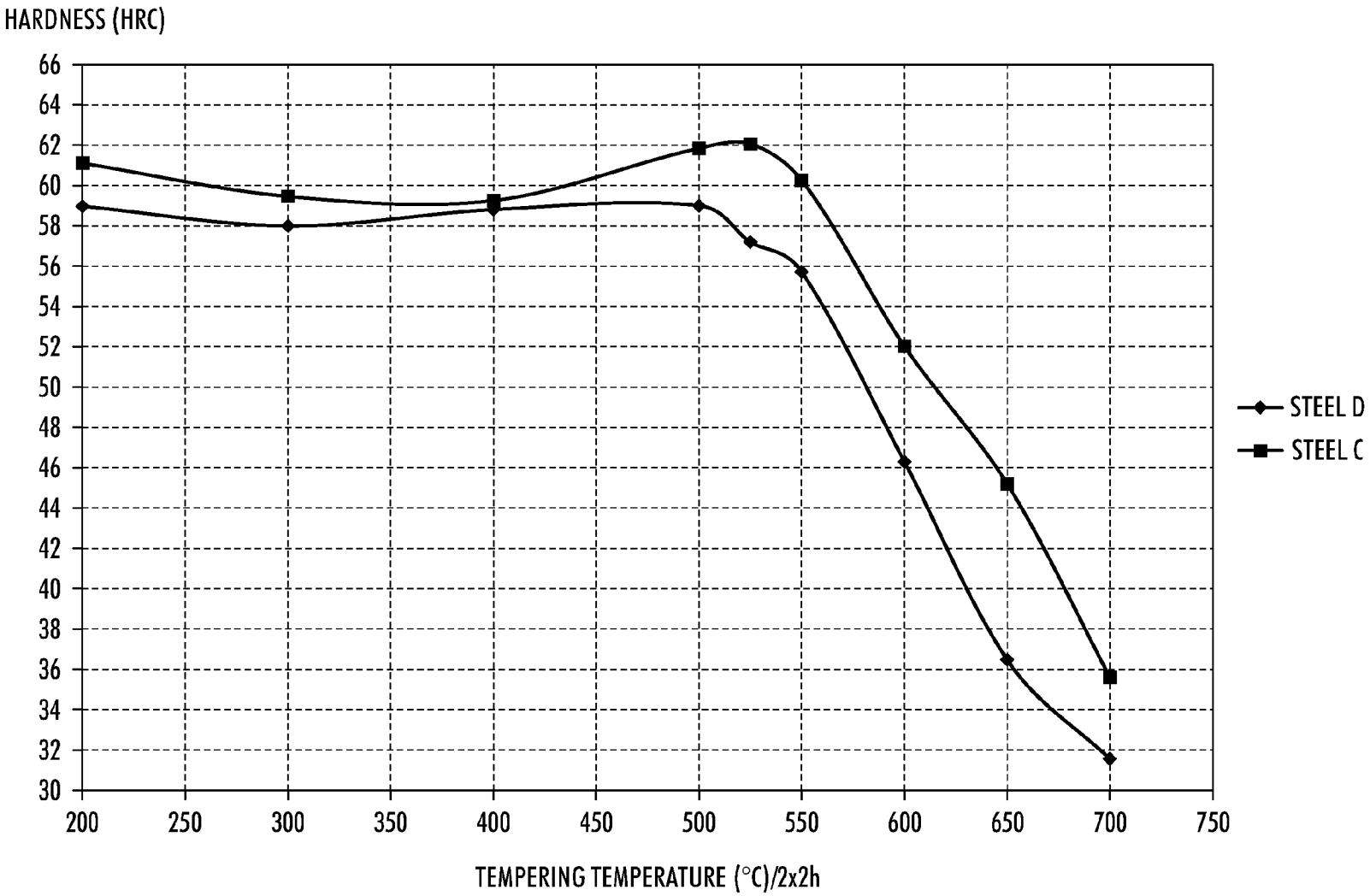
FIG. 8 shows the hardness of the steel according to the invention and of the reference material, respectively, versus the tempering temperature.

As is apparent from FIG. 8, steel C of the invention also had an essentially better tempering resistance than the reference steel D. A pronounced secondary hardening was achieved by tempering at a temperature between 500-550° C. The steel also gives a possibility to low temperature tempering at about 200-250° C.

The impact toughness of steels C and D was examined. The absorbed impact energy (J) in the LT2-direction was 102 J for steel C according to the invention, i.e. an extremely great improvement as compared with the hardness 60 J which was obtained for the reference material, steel D. The test specimens consisted of milled and ground, un-notched test bars having the dimension 7×10 mm and the length 55 mm, hardened to hardnesses according to table 2.

During wear tests there were used test specimens having the dimension Ø 15 mm and the length 20 mm. The test was performed via pin-to-pin test using $SiO_2$ as abrasive wear agent. Steel C of the invention had a lower wear rate, 8.3 mg/min, than the reference material, steel E, for which the wear rate was higher, 10.8 mg/min, i.e the wear resistance of that material was lower.

TABLE 2

| Steel | Heat treatment | Hardness (HRC) | Un-notched impact energy in the LT2-direction (J) | Wear rate (mg/min) |
|---|---|---|---|---|
| C | 1020° C./30 min + 550° C./2 × 2 h | 59.8 | 102 | 8.3 |
| D | 1020° C./30 min + 525° C./2 × 2 h | 58.5 | 60 | |
| E | 1050° C./30 min + 525° C./2 × 2 h | 61.7 | | 10.8 |

Figure 9:
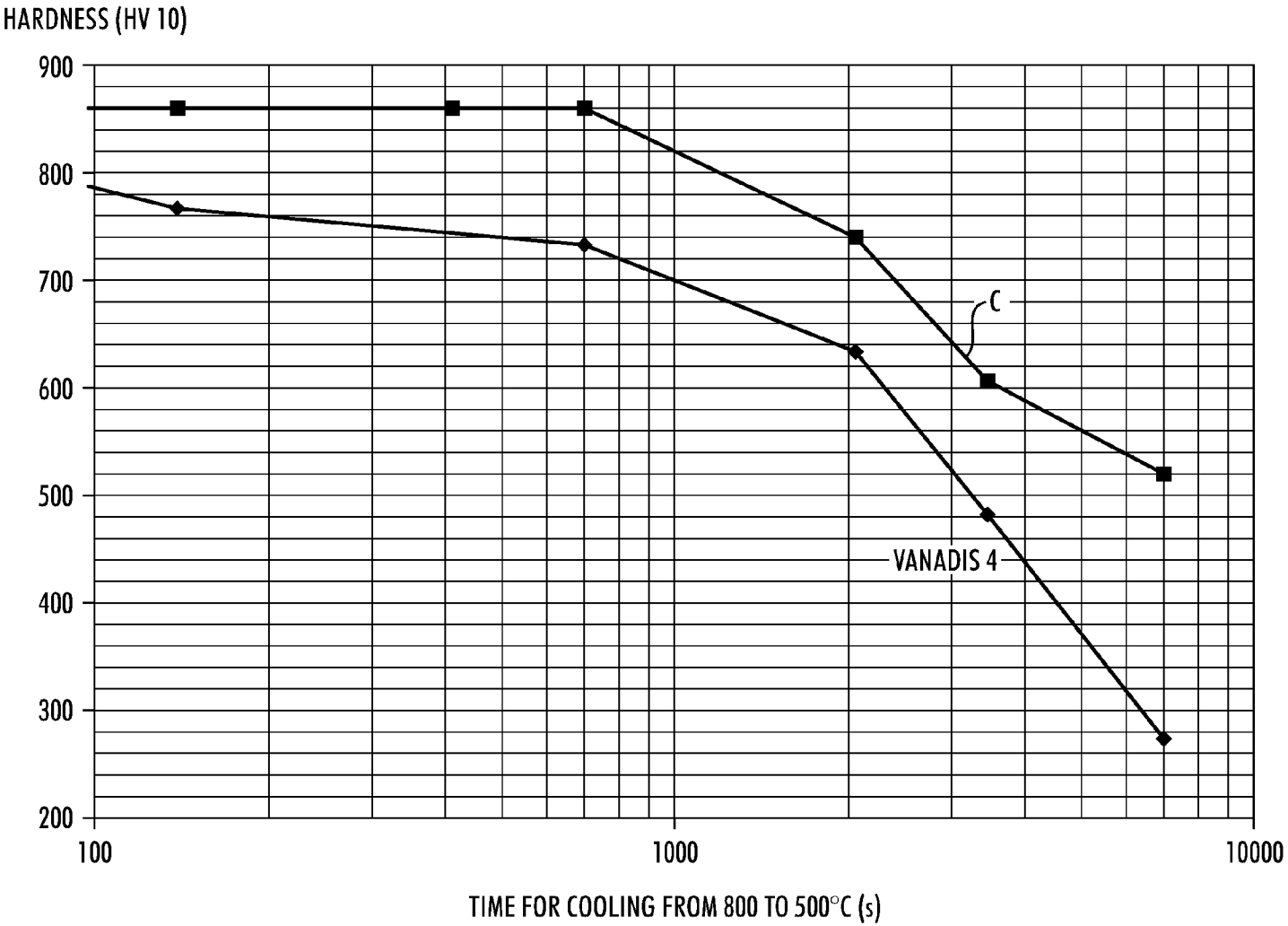
FIG. 9 shows hardenability curves for a steel of the invention and for a reference steel.

The hardenability of steel C of the invention and of a steel of type VANADIS® 4 manufactured in full scale production were examined. The austenitising temperature, TA, in both cases was 1020° C. The samples were cooled at different cooling rates, which were controlled by more or less intense cooling by means of nitrogen gas from the austenitising temperature, TA=1020° C., to room temperature. The periods required for cooling from 800° C. to 500° C. were measured as well as the hardness of the specimens which had been subjected to varying cooling rates. The results are stated in table 3. FIG. 9 shows the hardness versus the time for cooling from 800° C. to 500° C. As is apparent from this figure, which shows the hardenability curves for the examined steels, the curve for steel C of the invention lies at a significantly higher level than the curve for the reference steel, which means that the steel of the invention has an essentially better hardenability than the reference steel.

TABLE 3

Hardenability measurement; TA = 1020° C.

| Cooling period between 800° C. and 500° C. (Sec) | VANADIS ® 4 Hardness (HV10) | Steel C Hardness (HV10) |
|---|---|---|
| 139 | 767 | 858 |
| 415 | — | 858 |
| 700 | 734 | 858 |
| 2077 | 634 | 743 |
| 3500 | 483 | 606 |
| 7000 | 274 | 519 |

The invention claimed is:

1. Cold work steel in the hardened and tempered condition, manufactured powder metallurgically, having a wear rate of 8.3 mg/min, and having the following chemical composition in weight-%:

1.37% C
0.38% Si
0.37% Mn
4.81% Cr
3.50% Mo
0.1% W
357% V
max 0.3% S
0.064% N balance iron and unavoidable impurities;

and a microstructure which in the hardened and tempered condition of the steel contains 6-13 vol-% of vanadium-rich MX-carbides,-nitrides and/or carbonitrides which are evenly distributed in the matrix of the steel, where X is carbon and/or nitrogen, at least 90 vol-% of said carbides, nitrides and/or carbonitrides having an equivalent diameter, $D_{eq}$, which is smaller than 3.0 μm; and a total max. 1 vol-% of other existing carbides, nitrides or carbonitrides.

2. Steel according to claim 1, wherein the matrix of the steel in the hardened condition of the steel essentially only consists of manensite, which contains 0.3-0.7% C in solid solution.

3. Steel according to claim 1, wherein at least 98 vol-% of said MX-carbides, nitrides and/or carbonitrides have an equivalent diameter, $D_{eq}$, which is smaller than 3.0 μm.

4. Steel according to claim 2, wherein the steel, after hardening and tempering., has a hardness of 54-66 HRC.

5. Steel according to claim 4, wherein the steel, after hardening and tempering, has a hardness of 60-63 HRC.

6. Steel according to claim 1, wherein the steel contains 7-11 vol-% MX-carbides, nitrides and/or carbonitrides, where M consists substantially of vanadium and X is carbon and/or nitrogen.

7. Steel according to claim 6, wherein the steel contains 9.5 vol-% MC-carbides.

8. Steel according to claim 1, wherein the steel is manufactured powder metallurgically by manufacturing a powder of a molten metal and hot isostatic pressing the powder into a consolidated body.

9. Steel according to claim 8, wherein the hot isostatic pressing is performed at a temperature between 950 and 1200° C. and at a pressure between 90 and 150 MPa.

10. Steel according to claim 8, wherein the steel after hot isostatic pressing has been hot worked, starting at a starting temperature between 1050 and 1150° C.

11. Steel according to claim 9, wherein the steel is hardened from a temperature between 940 and 1150° C. and tempered at a temperature between 200 and 250° C. or at a temperature between 500 and 560° C.

12. Steel according to claim 1, wherein at least 90 vol-% of the MX-carbides, nitrides and/or carbonitrides have a maximal extension of 2.0 μm after hot isostatic pressing, hot working, soft annealing, hardening and tempering of the steel.

13. Cold work steel according to claim 1 wherein the steel has a ferritic matrix containing 8-15 vol-% MX-carbides, nitrides and/or carbonitrides, of which at least 90 vol-% have an equivalent diameter which is smaller then 3.0 μm, and max. 3 vol-% of other carbides, nitrides and/or carbonitrides after soft annealing and prior to hardening and tempering of the steel.

14. A tool for shearing, cuffing, blanking and/or metal forming of metallic working material in a cold condition of the material, or for pressing metal powder manufactured from a steel as claimed in claim 1.

15. Steel according to claim 2, wherein 0.4-0.6% C is in solid solution.

16. Steel according to claim 3, wherein said equivalent diameter, $D_{eq}$, is smaller than 2.5 μm.

17. Steel according to claim 4, wherein after hardening and tempering the hardness is 58-63 HRC.

18. Cold work steel according to claim 13 wherein the equivalent diameter is smaller than 2.5 μm.

* * * * *